United States Patent [19]

King et al.

[11] Patent Number: 4,534,797

[45] Date of Patent: Aug. 13, 1985

[54] METHOD FOR PROVIDING AN ELECTROLESS COPPER PLATING BATH IN THE TAKE MODE

[75] Inventors: David E. King, Endicott; Voya Markovich, Endwell; Carlos J. Sambucetti, Croton-on-Hudson; Stephen L. Tisdale; Donna J. Trevitt, both of Vestal, all of N.Y.

[73] Assignee: International Business Machines Corporation, Armonk, N.Y.

[21] Appl. No.: 567,723

[22] Filed: Jan. 3, 1984

[51] Int. Cl.[3] ..... C23C 3/02

[52] U.S. Cl. ..... 106/1.23; 106/1.26

[58] Field of Search ..... 106/1.23, 1.26

[56] References Cited

U.S. PATENT DOCUMENTS

| | | | |
|---|---|---|---|
| 2,938,805 | 5/1960 | Agens | 106/1.23 |
| 2,996,408 | 8/1961 | Lukes | 106/1.23 |
| 3,075,855 | 1/1963 | Agens | 106/1.26 |
| 3,075,856 | 1/1963 | Lukes | 106/1.23 |
| 3,844,799 | 10/1974 | Underkofler et al. | 106/1.23 |
| 4,096,301 | 6/1978 | Slominski et al. | 427/430 A |
| 4,152,467 | 5/1979 | Alpaugh et al. | 427/8 |
| 4,276,323 | 6/1981 | Oka et al. | 106/1.23 |
| 4,286,965 | 9/1981 | Vanhumbeeck et al. | 23/230 A |
| 4,324,589 | 4/1982 | Gulla et al. | 106/1.23 |

*Primary Examiner*—Lorenzo B. Hayes

*Attorney, Agent, or Firm*—Pollock, Vande Sande & Priddy

[57] ABSTRACT

An electroless copper plating bath which is in the take mode is provided by determining the amount in the bath of at least four of the components selected from the group of oxygen, reducing agent, cyanide salt, cupric salt, and complexing agent; solving the equation:

$$R=(CABD)/E$$

wherin C is the concentration of cupric salt, A is the concentration of reducing agent, B is the concentration of oxygen, D is the concentration of cyanide salt, E is the concentration of complexing agent, and R is a unitless number.

The bath is provided with quantities of the above ingredients so that R in the equation is between about 5 and about 15.

18 Claims, No Drawings

METHOD FOR PROVIDING AN ELECTROLESS COPPER PLATING BATH IN THE TAKE MODE

DESCRIPTION

1. Technical Field

The present invention is concerned with electroless copper plating baths and is especially concerned with providing electroless copper plating baths which are in the take mode. Accordingly, the present invention is concerned with electroless plating baths which are capable of initial plating onto a desired substrate. The present invention is concerned with measuring and maintaining certain bath parameters within predetermined values.

2. Background Art

Electroless copper plating is well-known in the prior art. An electroless or autocatalytic copper plating bath usually contains a cupric salt, a reducing agent for the cupric salt, a chelating or complexing agent, and a pH adjustor. Moreover, if the surface being plated is not already catalytic for the deposition of the copper, a suitable catalyst is deposited on the surface prior to contact with the copper plating bath. Among the more widely employed procedures for catalyzing a substrate is the use of a stannous chloride sensitizing solution and a palladium chloride activator to form a layer of metallic palladium particles.

In manufacturing very high quality articles, such as printed circuits, normally an initial electroless plating operation is employed which is generally referred to as a strike or flash bath followed by subsequent electroless plating employing the main bath, or followed by a subsequent electrodeposition plating procedure in order to obtain the desired thickness of the copper layer.

The strike bath is formulated in order to promote the initial copper plating on the catalytic surfaces. Generally, the substrates are subjected to a strike bath for about one hour and then transferred to the main additive electroless copper plating bath for an additional fifteen to twenty hours. The strike bath is formulated by design to be much more chemically active than the main additive bath. However, although strike baths are more chemically reactive than the main bath, certain problems occur with such baths. For instance, at times the strike bath, for one reason or the other, does not result in initial plating on the activated surfaces. This, in turn, can result in products which must be discarded in view of voids which may be present, for instance, in the holes and/or on the substrate being coated.

Moreover, there is a delicate balance between providing a bath which is sufficiently chemically active so as to provide take or initial copper plating and to prevent the bath from going out of control, resulting in formation of what is known as extraneous copper or nodules.

The proper control of the strike or flash bath, as well as the main bath, has been a particular concern as the demand for higher quality articles increases. For instance, various attempts at controlling electroless copper plating baths for maintaining preselected concentrations of certain components in the plating bath have been suggested. For example, see U.S. Pat. No. 4,096,301 to Slominski, et al. and U.S. Pat. No. 4,286,965 to Vanhumbeeck, et al., which are examples of suggestions for maintaining preselected concentrations of components in a plating bath.

SUMMARY OF INVENTION

The present invention is concerned with providing an electroless copper plating bath which is in the take mode. In particular, the method of the present invention includes determining the amount present in the bath of at least four of the components selected from the group of dissolved oxygen, cupric salt, reducing agent for the cupric salt, cyanide salt, and chelating or complexing agent. The following equation is solved:

$$R=(CABD)/E$$

wherein C is the concentration of cupric salt in g/l; A is the concentration of reducing agent for cupric salt in g/l; B is the concentration of $O_2$ in ppm; D is the concentration of cyanide salt in mg/l; and E is the concentration of complexing agent in g/l; and R is the calculated ratio.

The bath is provided with quantities of the oxygen; the cupric salt; the reducing agent for the cupric salt; cyanide salt; and chelating or complexing agent so that R in the above equation is between about 5 and about 15.

Moreover, the amount of dissolved oxygen must be about 0.5–2.0 ppm; the amount of reducing agent must be about 2.0–2.5 ml/l; the amount of said cyanide salt must be about 10 to about 12 mg/l; the amount of said cupric salt must be about 8.5–10 g/l; and the amount of the complexing or chelating agent must be about 38 to about 45 g/l.

By following the above procedure, baths having marginal take conditions can be readily identified and can be converted to baths in the take mode prior to inserting of substrates to be coated in order to further insure the elimination of voids and other coating problems. In addition, in plant operations, calculations can be readily made for any one of the above parameters to adjust the bath for take conditions.

In preparing a bath for take conditions, only four of the above five parameters need initially be measured and determined and, if within the above ranges, then the value for the fifth parameter will be fixed, since R must be between about 5 and about 15. In the preferred aspects of the present invention, either the complexing agent or the dissolved oxygen can be the parameter used to adjust the composition to be within the above defined take conditions.

BEST AND VARIOUS MODES FOR CARRYING OUT INVENTION

According to the present invention, it has been found that within the concentration levels discussed herein, the parameters of dissolved oxygen, cupric salt, reducing agent for the cupric salt, cyanide salt, and complexing agent are interrelated for take conditions by the following equation:

$$R=(CABD)/E$$

In said equation, R is a number which must be between about 5 and about 15, preferably between about 7 and about 12, and most preferably, about 10 to 11 g.ppm.mg/(liter)$^2$. In addition, it is necessary that the oxygen content of the bath be maintained between about 0.5 and about 2.0 ppm and preferably about 1 to 1.5 ppm, the cupric salt concentration be maintained between 8.5 and 10 g/l, the reducing agent for the cupric salt be maintained between about 2.0 and 2.5 m/l, the cyanide salt be maintained between about 10 and about 12 mg/l, and the complexing agent be maintained to about 38 to about 45 g/l.

The determination of the various amounts of the above substituents can be carried out by well-known analytical techniques using well-known equipment which need not be described herein in any great detail. For instance, the dissolved oxygen can be determined by use of a dissolved oxygen meter-probe such as a Leeds and Northrup Monitor 7931-10 and Probe 7931-30.

The cyanide concentration can be determined by a cyanide electrode and meter such as a Beckman Monitor 646949 pH-Model 942 and Graphic Controls Probe pH-193150 having a pH range of 11–13. The cupric salt can be determined by a UV-VIS. For example, a Gilford spectrophotometer Model STA-SAR 2 has been used for the cupric salt determination. The complexing agent and reducing agent can be determined by known potentiometric titrations.

In preparing a bath for take conditions, only four of the five parameters need initially be measured and determined and if within the above ranges, then the value for the fifth parameter will be fixed, since R must be between about 5 and about 15. In the preferred aspects of the present invention, either of the complexing agent of the dissolved oxygen can be the parameter used to adjust the composition to be within the above-defined take conditions.

Moreover, if desired, the determination of the quantities of materials can be carried out prior to the insertion of the substrates to be coated or can be carried out continuously during the coating operation. It is preferable to do so prior to insertion of the substrates to be coated.

The level of oxygen is maintained by introducing into the plating tank a mixture of oxygen and inert gas, preferably adding air.

Mixed with the air or oxygen can be an inert gas such as hydrogen, nitrogen, argon, neon, and krypton. The preferred inert gas, if employed, is nitrogen. Mixtures of inert gas and oxygen and the inert gas and air at the temperature of operation of the electroless bath are selected in order to obtain the desired amount of oxygen in the bath. At a plating temperature of 73+C.±0.5° C., and 1.0–2.0 SCFM (standard cubic feet per minute) per thousand gallons of bath of air can be used.

When used, the inert gas is preferably premixed with the oxygen or air prior to introduction into the bath. However, the individual gases can be introduced into the bath separately if desired.

The copper electroless plating baths which are provided according to the present invention are aqueous compositions which include a source of cupric ion, a reducing agent for the cupric ion, a complexing agent for the cupric ion, and a cyanide ion source. The plating baths also usually contain a pH adjustor and surface-active agent.

The cupric ion source generally used is a cupric sulfate or a cupric salt of the complexing agent to be employed.

The cupric ion source is employed in amounts of about 8.5 to about 10.0 g/l, calculated as $CuSO_4.5H_2O$. In other words, when the cupric ion source is $CuSO_4.5H_2O$, then the amount is about 8.5 to about 10.0 g/l, and when the source is a different material, the amount employed will be such that the same amount of cupric ion will be present in the composition as when $CuSO_4.5H_2O$ is used.

The most common reducing agent employed is formaldehyde. Examples of some other reducing agents include formaldehyde precursors or formaldehyde homopolymers such as paraformaldehyde, trioxane, and glyoxal. Mixtures can be employed if desired.

The reducing agent is present in amounts of about 2.0 to about 2.5 ml/l, calculated as formaldehyde. In other words, when the reducing agent is formaldehyde, then the amount of about 2.0 to about 2.5 ml/l, and when the reducing agent is a precursor or homopolymer of formaldehyde, the amount employed will be such that the same amount of free formaldehyde will be present in the composition.

Examples of some suitable complexing agents include Rochelle salts, ethylene diamine tetraacetic acid, the sodium (mono-, di-, tri-, and tetra-sodium) salts of ethylene diamine tetraacetic acid, nitrolotetraacetic acid and its alkali salts, gluconic acid, gluconates, triethanol amine, glucono (gamma)-lactone, modified ethylene diamine acetates, such as N-hydroxyethyl, ethyl diamine triacetate. In addition, a number of other suitable cupric complexing agents are suggested in U.S. Pat. Nos. 2,996,408; 3,075,856; 3,075,855; and 2,938,805.

The preferred complexing agent is ethylene diamine tetraacetic acid.

The amount of complexing agent is about 38 to about 45 g/l.

Examples of some cyanides which can be employed according to the present invention are the alkali metal, alkaline earth metal, and ammonium cyanides, with sodium cyanide being preferred. The amount of cyanide ion employed is equivalent to about 10.0 to about 12.0 mg/l of sodium cyanide. In other words, with the cyanide ion source is sodium cyanide, then the amount is about 10 to about 12 mg/l, and when the cyanide source is a different material, the amount employed will be such that the same amount of cyanide ion will be present in the composition as when sodium cyanide is used.

The plating bath can also include a surfactant which assists in wetting the surface to be coated. A satisfactory surfactant is, for instance, an organic phosphate ester, available under the trade designation "Gafac RE-610". Generally, the surfactant is present in amounts from about 0.02 to about 0.3 g/l. In addition, the pH of the bath is also generally controlled for instance, by the addition of a basic compound such as sodium hydroxide or potassium hydroxide in the desired amount to achieve the desired pH. The preferred pH of the electroless plating bath is between 11.6 and 11.8 and most preferably, between 11.7 and 11.8. In addition, the plating bath can include other minor additives, as is known in the art.

The preferred plating baths employed have a specific gravity within the range of 1.060 to 1.080. Moreover, the temperature of the bath is preferably maintained between about 70° C. and 80° C. and more preferably, between about 70° C. and 75° C. and most preferably, about 72° C. to about 74° C.

The following Table 1 illustrates the need to provide baths having the proper relationship and amounts of the ingredients, as discussed hereinabove, in order to assure that the bath is in the take mode:

TABLE 1

| Bath No. | R | Take | $pO_2$ ppm | $CuSO_4.5H_2O$ g/l | NaCN mg/l | HCHO ml/l | EDTA g/l |
|---|---|---|---|---|---|---|---|
| 1 | 22.6 | No | 3.2 | 10.0 | 12.5 | 2.1 | 36.0 |
| 2 | 11.0 | Yes | 1.75 | 9.2 | 12.5 | 2.0 | 35.5 |
| 3 | 12.4 | Yes | 2.2 | 9.8 | 9.0 | 3.8 | 59.2 |
| 4 | 8.5 | Yes | 1.8 | 7.2 | 11.5 | 2.2 | 38.6 |
| 5 | 15.5 | No | 2.7 | 7.4 | 11.5 | 2.6 | 39.2 |
| 6 | 10.6 | No | 1.6 | 9.0 | 12.5 | 2.2 | 37.5 |

The above Table 1 demonstrates that when R is outside of the recited range, "take" conditions are not achieved, e.g., Bath No. 1, and even when R is within the recited range, but amounts of constituents are outside of the required amounts, "take" conditions are not achieved. For instance, for Bath 5, the oxygen content was higher than the amounts required by the present invention and the cupric salt content was lower than the amounts required by the present invention. Also, in Bath 6, the cyanide content was higher than that required by the present invention and the complexing agent was lower than that required by the present invention.

Although Baths 3 and 4 resulted in "take", such contained amounts of materials outside of the ranges required by the present invention such lead to high nodule formation which, in turn, can cause a high level of scrap boards. Bath 3 contains higher oxygen, reducing agent, and complexing agent than that required by the present invention; and lower cyanide content than that required by the present invention.

Bath 4 contains lower cupric salt than that required by the present invention.

What is claimed is:

1. A method for providing an electroless copper plating bath in the take mode which comprises:

A. determining the amount in said bath of at least four of the components selected from the group of dissolved oxygen, reducing agent selected from the group of formaldehyde, formaldehyde precursors, formaldehyde homopolymers, and mixtures thereof, cyanide ion, cupric ion, and complexing agent;

B. solving the following equation:

$$R=(CABD)/E$$

wherein

C=concentration of cupric salt in g/l, calculated as $CuSO_4.5H_2O$

A=concentration of reducing agent in g/l

B=concentration of $O_2$, ppm

D=concentration of cyanide ion in mg/l, calculated as NaCN

E=concentration of complexing agent in g/l

C. providing the bath with quantities of said oxygen, reducing agent, cyanide ion source, cupric ion source, and complexing agent so that R, in said equation, is between about 5 and about 15 (g.ppm.mg/(liter)$^2$ and wherein the amount of said dissolved oxygen is about 0.5–2.0 ppm; amount of said reducing agent is about 2.0–2.5 ml/l calculated as formaldehyde; the amount of said cyanide salt is about 10 to about 12 mg/l, calculated as sodium cyanide; the amount of said cupric salt is about 8.5 to 10 g/l calculated as $CuSO_4.5H_2O$, and the amount of said complexing agent is about 38 to 45 g/l.

2. The method of claim 1 wherein said reducing agent is formaldehyde; said cupric ion source is $CuSO_4.5H_2O$; said cyanide ion source is sodium cyanide; and said complexing agent is ethylene diamine tetraacetic acid.

3. The method of claim 1 wherein R is about 7 to about 12 (g.ppm.mg/(liter)$^2$.

4. The method of claim 1 wherein R is about 10.

5. The method of claim 1 wherein the bath has a pH of about 11.6 to about 11.8 and the bath is operated at a temperature of about 70° to about 80° C.

6. The method of claim 1 wherein the bath is operated at a temperature of about 70° to about 75° C.

7. The method of claim 1 wherein the bath is operated at a temperature of about 72° to about 74° C.

8. The method of claim 1 wherein the bath is adjusted by varying the amount of dissolved oxygen.

9. The method of claim 1 wherein the bath is adjusted by varying the amount of the complexing agent.

10. The method of claim 1 wherein said reducing agent is formaldehyde.

11. The method of claim 1 wherein said cupric ion source is $CuSO_4.5H_2O$.

12. The method of claim 1 wherein cyanide ion source is sodium cyanide.

13. The method of claim 1 wherein said complexing agent is ethylene diamine tetraacetic acid.

14. The method of claim 1 wherein said oxygen content is about 1 to 1.5 ppm.

15. The method of claim 2 wherein said oxygen content is about 1 to 1.5 ppm.

16. The method of claim 2 wherein R is about 7 to about 12 (g.ppm.mg)/(liter)$^2$.

17. The method of claim 2 wherein R is about 10 to 11 (g.ppm.mg)/$1^2$.

18. The method of claim 1 wherein the specific gravity of the bath is 1.060 to 1.080.

* * * * *